United States Patent [19]

Bühler et al.

[11] 4,386,935

[45] Jun. 7, 1983

[54] PROCESS FOR PRODUCING DISCHARGE RESERVE PRINTS ON TEXTILE MATERIALS WITH AMINO-AZO-BENZENE DYES

[75] Inventors: Ulrich Bühler, Schöneck; Klaus Kühlein, Kelkheim; Theo Stahl, Frankfurt; Horst Tappe, Dietzenbach; Kurt Roth, Hofheim, all of Fed. Rep. of Germany

[73] Assignee: Cassella Aktiengesellschaft, Frankfurt am Main, Fed. Rep. of Germany

[21] Appl. No.: 305,998

[22] Filed: Sep. 28, 1981

[30] Foreign Application Priority Data

Oct. 31, 1980 [DE] Fed. Rep. of Germany ..... 3041014

[51] Int. Cl.[3] ..... D06P 5/12; C09B 29/08

[52] U.S. Cl. ..... 8/451; 8/456; 8/464; 8/449; 8/532; 8/543

[58] Field of Search ..... 8/464, 456, 466, 532, 8/451

[56] References Cited

U.S. PATENT DOCUMENTS

| | | | |
|---|---|---|---|
| 3,990,839 | 11/1976 | von der Eltz | 8/482 |
| 4,023,925 | 5/1977 | Fadler | 8/532 |
| 4,252,580 | 2/1981 | Ribka et al. | 8/457 |
| 4,265,629 | 5/1981 | Ribka et al. | 8/464 |
| 4,313,731 | 2/1982 | Imahori et al. | 8/464 |

FOREIGN PATENT DOCUMENTS

| | | |
|---|---|---|
| 23660 | 2/1981 | European Pat. Off. . |
| 51818 | 5/1982 | European Pat. Off. . |
| 50-50478 | 5/1975 | Japan . |
| 1543724 | 4/1979 | United Kingdom . |

OTHER PUBLICATIONS

Chemical Abstract vol. 83:148990.

Research Disclosure, vol. 198, Oct. 1980, pp. 415–416, No. 19827.

*Primary Examiner*—A. Lionel Clingman

*Attorney, Agent, or Firm*—Connolly and Hutz

[57] ABSTRACT

An improved process for producing discharge reserve prints on textile materials comprising water-repellent fibers or mixed water-repellent and cellulose fibers wherein a disperse dyestuff which is dischargeable to white is applied to the textile material in the form of a dye liquor or dye printing paste, at least partially drying the textile material, applying a discharge reserve printing paste to the material by printing on the material in the desired pattern and subsequently heating the printed material at temperatures from 100° to 230° C., with the improvement comprising (a) the discharge reserve printing paste containing, as the discharging agent, an alkaline material which produces a pH value of at least 8 in 5% strength aqueous solution and (b) the disperse dyestuff which is dischargeable to white is a disperse dyestuff of the formula

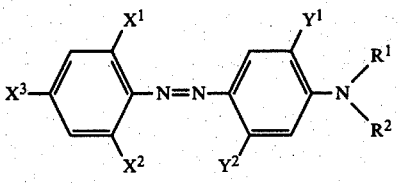

as more fully defined herein.

11 Claims, No Drawings

PROCESS FOR PRODUCING DISCHARGE RESERVE PRINTS ON TEXTILE MATERIALS WITH AMINO-AZO-BENZENE DYES

The present invention relates to a process for producing discharge reserve prints on textile materials which are composed of water-repellent fibres, preferably polyester fibres, or which contain such fibres mixed with cellulose fibres, wherein a disperse dyestuff which is dischargeable to white and, if appropriate, a disperse dyestuff which is resistant to discharging agents are applied, in the form of a dye liquor or printing paste, to the textile material and are then dried or incipiently dried, and a discharge reserve printing paste which, if appropriate, also contains, in addition to the discharging agent, dyestuffs which are resistant to discharging agents, is subsequently printed on the material in the desired pattern and the material is subsequently subjected to a heat treatment at temperatures from 100° to 230° C.

It has always been a problem in textile printing to produce white or coloured patterns having sharp outlines on a dark-coloured background. In particular, direct printing of the textile material breaks down completely when producing filigree-like patterns on a dark substrate. In order to produce designs of this type, it is known to print a discharge paste in the desired pattern onto a deep background dyeing produced by means of a dyestuff which is dischargeable to white, and then destroying the dyestuff at the areas printed with the discharge paste, by means of a dry or wet heat treatment. The desired pattern is obtained as white on a dark ground after the prints thus obtained have been washed out. It is also already known to add to the discharge printing pastes dyestuffs which are resistant to the discharging agent. In this case, the textile material is dyed at the printed areas by the indestructable dyestuff at the same time as the ground dyeing is destroyed. Coloured prints on a dark ground are obtained in this case. Coloured prints on a dark ground can also be obtained if the dark ground is produced using a mixture of a dischargeable dyestuff and a non-dischargeable dyestuff of a different colour.

In applying these known processes to synthetic fibre materials or to textile materials composed, preferably, of water-repellent synthetic fibres, a problem arises in that it is very difficult to discharge, for example, polyester fibres which have been dyed with disperse dyestuffs. Once disperse dyestuffs have been fixed, that is to say dissolved, in the polyester fibre, they are largely withdrawn from the reach of aqueous agents and thus also from attack by aqueous discharge pastes. When producing discharge prints on textile materials containing or composed of water-repellent fibres, the known discharge printing process is, therefore, modified by first padding the textile material with a dye liquor containing a disperse dyestuff and drying it or incipiently drying it, but in the course of this the dyestuff must not become fixed, that is to say dissolved, in the water-repellent fibre. The desired pattern is then printed by means of the discharge printing paste on the dried, or incipiently dried, padded fabric and the padded and printed fabric is then subjected to a heat treatment, in the course of which the ground dyestuff on the areas which have not been printed migrates into the polyester, that is to say becomes fixed, and at the same time the dyestuff is destroyed on the printed areas, that is to say no dyeing takes place. In view of this mechanism, this process is also termed discharge reserve printing.

The process of discharge reserve printing, which is in itself simple, contains a number of technical difficulties which frequently make its use difficult. Thus, it is, as a rule, not easy to destroy the ground dyestuff completely by means of the discharging agent. If this is not achieved, a coloured residue with a hue which can vary between yellow-brown and dull violet or reddish-tinged grey shades remains on the discharged areas and soils the white ground at the discharged areas. This results in white discharges which appear muddy or, in the event that a coloured discharge is to be produced, results in a false hue for the dyestuff which is resistant to discharging agents. In order to overcome this difficulty, discharge pastes are used containing relatively strong reducing agents or oxidising agents, such as, for example, sodium dithionite, in conjunction with an alkali, alkali metal formaldehydesulphoxylates or even heavy metal salts, such as, for example, tin-II chloride. Although strong discharging agents of this type generally make it possible to achieve a satisfactory white discharge print, damage to the fibre material is frequently caused, particularly if the polyester fibre also contains accompanying fibres, such as, for example, cellulose fibres. Furthermore, these discharging agents are, as a rule, not cheap and, in the case of heavy metal discharging agents, they constitute an additional ecological pollution or cause additional expense in effluent purification. In addition to this, there are only relatively few types of dyestuff which are resistant to such discharging agents, so that there is relatively little choice of dyestuffs which are resistant to discharging agents and which can be used for the production of coloured discharges.

In order to overcome these difficulties, disperse dyestuffs which can be discharged to pure white using agents with as mild an action as possible are required for dyeing the background. German Offenlegungsschriften Nos. 2,612,740, 2,612,741, 2,612,742, 2,612,790, 2,612,791 and 2,612,792 disclose disperse dyestuffs which contain at least two esterified carboxyl groups in their molecule. When treated with aqueous alkalis, dyestuffs of this type are saponified with the formation of alkali-soluble dyestuffs containing carboxylate groups. The use of such dyestuffs as disperse dyestuffs for dyeing polyester materials has the advantage that residues of dyestuff which have not been fixed can be washed out from the textile material by a simple treatment with agents having an alkaline action. It is also already known that residues of dyestuff which have not been fixed can be removed easily, by treating the fibre with alkali, from dyeings effected with disperse dyestuffs containing pyridone derivatives as the coupling component. However, these dyestuffs, which are soluble in aqueous alkalis, suffer from the disadvantage, insofar as pyridone dyestuffs are concerned, that they can essentially only be employed for yellow or reddish-tinged yellow shades, and, insofar as dyestuffs containing esterified carboxyl groups are concerned, the disadvantage that they exhibit, after the ester groups have been saponified, a certain affinity for hydrophilic fibres, such as, for example, wool, cotton or polyamide fibres, and stain or soil the latter. In addition, the diazo and/or coupling components required for the manufacture of dyestuffs containing carboxylic acid ester groups are not substances customary in large-scale chemical industry, but must be specially prepared for these types of dyestuffs, which is uneconomic as a rule. The types of dyestuff indicated above have not, therefore, been able to satisfy the necessity to employ, under relatively mild discharging conditions, disperse dyestuffs which can be discharged to pure white in the process of discharge reserve printing on water-repellent textile materials.

It has now been found, surprisingly, that the difficulties in carrying out discharge reserve printing on textile materials composed wholly or mainly of water-repellent synthetic fibres, can be overcome if disperse dyestuffs which are dischargeable to white in a manner which is in itself known, and, if appropriate, disperse dyestuffs which are resistant to discharging agents are applied in the form of a dye liquor or printing paste to these materials, and the fabric is then dried or incipiently dried and subsequently printed in the desired pattern with a discharge reserve printing paste which, if appropriate, in addition to the discharging agent also contains a disperse dyestuff which is resistant to discharging agents, if the disperse dyestuff which is dischargeable to white which is employed is a disperse dyestuff of the formula I

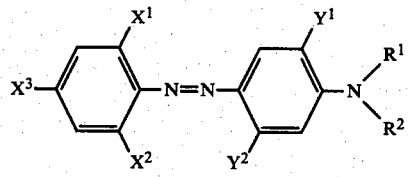

(I)

wherein $X^1$, $X^2$ and $X^3$ independently of one another denote nitro, cyano, alkylsulphonyl having 1 to 4 C atoms, phenylsulphonyl which is optionally substituted by chlorine, bromine or methyl, dialkylphosphono having 1 to 4 C atoms in each alkyl radical, alkoxycarbonyl which has 1 to 4 C atoms in the alkoxy radical and which is optionally substituted by hydroxyl, methoxy, ethoxy or methoxyethoxy, aminosulphonyl or alkylaminosulphonyl or dialkylaminosulphonyl having 1 to 4 C atoms in each of the alkyl groups, which are optionally substituted by hydroxyl, methoxy, ethoxy or methoxyethoxy, or denote trifluoromethyl, with the proviso that not more than 2 of the radicals $X^1$, $X^2$ or $X^3$ represent aminosulphonyl, alkylaminosulphonyl or dialkylaminosulphonyl which are optionally substituted, trifluoromethyl, dialkylphosphono having 1 to 4 C atoms in each alkyl radical or alkoxycarbonyl having 1 to 4 C atoms in the optionally substituted alkyl radical; $Y^1$ and $Y^2$ independently of one another denote hydrogen, chlorine, bromine, alkyl which has 1 to 4 C atoms and is optionally monosubstituted or disubstituted by hydroxyl, alkoxy which has 1 to 4 C atoms and which can optionally be monosubstituted by alkoxycarbonyl having 1 to 4 C atoms in the alkoxy group or by hydroxyl, or can be disubstituted by hydroxyl, or alkoxy which has 3 to 8 C atoms and is optionally monosubstituted or polysubstituted by hydroxyl and in which the carbon chain is interrupted by 1 to 3 oxygen atoms, $Y^2$ additionally also denotes —NHCOZ wherein Z represents methyl, ethyl, propyl or i-propyl which can be substituted by hydroxyl, chlorine, bromine, cyano, phenyl or phenoxy or alkoxycarbonyl having 1 to 4 C atoms in the alkoxy group, alkyl which has 2 to 8 C atoms and which is interrupted between one and three times by oxygen and which can be substituted by hydroxyl, phenyl, amino or N-alkylamino having 1 to 4 C atoms, $R^1$ denotes hydrogen or alkyl which has 1 to 4 C atoms and which can be monosubstituted by chlorine, bromine, cyano, alkoxycarbonyl having 1 to 2 C atoms in the alkoxy group which is optionally substituted by hydroxyl, methoxy, ethoxy, chlorine, bromine or cyano, alkanoyloxy having 2 to 4 C atoms, phenoxyacetoxy, alkylaminocarbonyloxy having 1 to 4 C atoms in the alkyl group, phenyl, phenoxy or hydroxyl, or which can be disubstituted by hydroxyl or which can be substituted at the same time by chlorine and hydroxyl or hydroxyl and phenoxy, or $R^1$ denotes alkenyl having 3 to 4 C atoms, benzyl, cycloalkyl having 5 or 6 C atoms, or alkyl which has 3 to 8 C atoms and in which the carbon chain is interrupted by 1 to 3 oxygen atoms and which can be monosubstituted or polysubstituted by hydroxyl, chlorine, bromine or cyano, and $R^2$ denotes alkyl which has 1 to 4 C atoms and which can be monosubstituted by chlorine, bromine, cyano, alkanoyloxy having 2 to 4 C atoms, alkylaminocarbonyloxy having 2 to 4 C atoms, or hydroxyl or can be disubstituted by hydroxyl or can be substituted at the same time by chlorine and by hydroxyl, or $R^2$ denotes alkenyl having 3 to 4 C atoms or alkyl which has 3 to 8 C atoms and in which the carbon chain is interrupted by 1 to 3 oxygen atoms and which can be monosubstituted or polysubstituted by hydroxyl, chlorine, bromine or cyano, with the proviso that not more than one of the radicals $X^1$, $X^2$, $X^3$, $Y^1$, $Y^2$, $R^1$ and $R^2$ carries an alkoxycarbonyl group having 1 to 4 C atoms in the optionally substituted alkoxy radical, and if a discharge reserve printing paste is used which contains, as the discharging agent, a base which produces a pH value of at least 8 in a 5% strength aqueous solution.

Alkyl or alkoxy radicals can be straight-chain or branched, even when they constitute parts of other radicals. In the event of multiple substitution of the alkyl radical which is represented by $R^1$ and/or $R^2$ and which has 3 to 8 C atoms and in which the carbon chain is interrupted by 1 to 3 oxygen atoms, disubstitution is particularly suitable, above all disubstitution by 2 OH groups or by one OH group and a chlorine atom.

Examples of alkyl radicals which have 1 to 4 C atoms in the alkylsulphonyl and dialkylphosphono substituents and which can be represented by $X^1$, $X^2$ or $X^3$, are methyl, ethyl, propyl, butyl and i-butyl.

The following are examples of substituents which can be represented by $Y^1$: hydrogen, chlorine, bromine, methyl, ethyl, propyl, i-propyl, n-butyl, 2-butyl, i-butyl, t-butyl, hydroxymethyl, α-hydroxyethyl, β-hydroxyethyl, α-hydroxy-n-propyl, α-hydroxy-i-propyl, α-hydroxy-n-butyl, α-hydroxy-2-butyl, α-hydroxy-i-butyl or dihydroxypropyl; methoxy, ethoxy, propoxy, i-propoxy, n-butoxy, i-butoxy, sec.-butoxy, β-hydroxyethoxy, β-hydroxypropoxy, γ-hydroxypropoxy, γ-hydroxybutoxy, δ-hydroxybutoxy or β,γ-dihydroxypropoxy; methoxycarbonylmethoxy, ethoxycarbonylmethoxy, 2-(methoxycarbonyl)-ethoxy or 2-(propoxycarbonyl)-ethoxy; 2-(methoxycarbonyl)-propoxy or 2-(methoxycarbonyl)-1-methylethoxy; 2-methoxyethoxy, 2-ethoxyethoxy, 2-butoxyethoxy, 3-methoxypropoxy, 3-ethoxypropoxy, 4-methoxybutoxy, 4-propoxybutoxy, 2-(β-hydroxyethoxy)-ethoxy, 2-(β-methoxyethoxy)-ethoxy, 2-(β-ethoxyethoxy)-ethoxy, 9-hydroxy-1,4,7-trioxanonyl (=hydroxyethoxyethoxyethoxy), 1,4,7,10-tetraoxadodecyl (=ethoxyethoxyethoxyethoxy), 3-(β-hydroxyethoxy)-propoxy, 3-(β-methoxyethoxy)-propoxy, 10-hydroxy-1,5,8-trioxadecenyl (=3-(hydroxyethoxyethoxy)-propoxy), 1,5,8,11-tetraoxatridecyl (=3-(ethoxyethoxyethoxy)- propoxy), 4-(β-hydroxyethoxy)-butoxy, 4-(β-ethoxyethoxy)-butoxy, 11-hydroxy-1,6,9-trioxaundecyl (=4-(hydroxyethoxyethoxy)-butoxy), 1,6,9,12-tetraoxatridecyl (=4-(methoxyethoxyethoxy)-butoxy) or 2-(β,γ-dihydroxypropoxy)-ethoxy.

The following are examples of substituents which can be represented by $Y^2$: hydrogen, chlorine or bromine; methyl, ethyl, propyl, i-propyl, n-butyl, 2-butyl, i-butyl or t-butyl; hydroxymethyl, α-hydroxyethyl, β-hydroxyethyl, α-hydroxy-n-propyl, α-hydroxy-i-propyl, α-hydroxy-butyl, α-hydroxy-2-butyl or α-hydroxy-i-butyl; or dihydroxypropyl; methoxy, ethoxy, propoxy, i-propoxy, n-butoxy, i-butoxy, sec.-butoxy, β-hydroxyethoxy, β-hydroxypropoxy, γ-hydroxypropoxy, γ-hydroxybutoxy, δ-hydroxybutoxy or β,γ-dihydroxypropoxy; methoxycarbonylmethoxy, propoxycarbonylmethoxy, 2-(methoxycarbonyl)-ethoxy or 2-(butoxycarbonyl)-ethoxy; 2-(ethoxycarbonyl)-propoxy or 2-(methoxycarbonyl)-1-methylethoxy; methoxyethoxy, 2-ethoxyethoxy, 2-propoxyethoxy, 3-methoxypropoxy, 3-propoxypropoxy, 4-methoxybutoxy, 4-butoxybutoxy, 2-(β-hydroxyethoxy)-ethoxy, 2-(β-methoxyethoxy)-ethoxy, 2-(β-ethoxyethoxy)-ethoxy, 9-hydroxy-1,4,7-trioxanonyl (=hydroxyethoxyethoxyethoxy), 1,4,7,10-tetraoxadodecyl (=ethoxyethoxyethoxyethoxy), 10-hydroxy-1,5,8-trioxadecenyl (=3-(hydroxyethoxy)-propoxy), 3-(β-ethoxyethoxy)-propoxy, 10-hydroxy-1,5,8-trioxadecenyl (=3-(hydroxyethoxyethoxy)-propoxy),1,5,8,11-tetraoxatridecyl (=3-(ethoxyethoxyethoxy)-propoxy), 4-(β-hydroxyethoxy)-butoxy, 4-(β-ethoxyethoxy)-butoxy, 11-hydroxy-1,6,9-trioxaundecyl (=4-(hydroxyethoxyethoxy)-butoxy), 1,6,9,12-tetraoxatridecyl (=4-(methoxyethoxyethoxy)-butoxy) or 2-(β-γ-dihydroxypropoxy)-ethoxy; acetylamino, n-propionylamino, n-butyrylamino or i-butyrylamino; chloroacetylamino, bromoacetylamino, cyanoacetylamino, hydroxyacetylamino, methoxycarbonylacetylamino, ethoxycarbonylacetylamino, phenylacetylamino or phenoxyacetylamino; 2-chloropropionylamino, 3-chloropropionylamino, 2-bromopropionylamino, 3-bromopropionylamino, 2-cyanopropionylamino, 3-cyanopropionylamino, 2-hydroxypropionylamino, 3-hydroxypropionylamino or 3-(methoxycarbonyl)-propionylamino; 2-chloro-n-butyrylamino, 2-bromo-n-butyrylamino, 2-cyano-n-butyrylamino, 2-hydroxy-n-butyrylamino, 2-chloro-i-butyrylamino, 2-bromo-i-butyrylamino, 2-cyano-i-butyrylamino or 2-hydroxy-i-butyrylamino; methoxyacetylamino, ethoxyacetylamino, 2-methoxypropionylamino, 3-methoxypropionylamino, 2-ethoxypropionylamino, 3-ethoxypropionylamino, 2-methoxy-n-butyrylamino, 2-butoxy-n-butyrylamino, 2-methoxy-i-butyrylamino or 2-butoxy-i-butyrylamino; hydroxyethoxyacetylamino, methoxyethoxyacetylamino, propoxyethoxyacetylamino, 2-hydroxyethoxypropionylamino, 2-methoxyethoxypropionylamino, 2-butoxyethoxypropionylamino, 3-hydroxyethoxypropionylamino, 3-methoxyethoxypropionylamino or 3-butoxyethoxypropionylamino; hydroxyethoxyethoxyacetylamino, ethoxyethoxyethoxyacetylamino, propoxyethoxyethoxyacetylamino, 3-hydroxy-n-propoxyethoxyethoxypropionylamino or 3-hydroxy-i-propoxyethoxyethoxypropionylamino; 2,3-dihydroxypropoxyacetylamino; 3-(2,3-dihydroxypropoxy)-propionylamino; benzoylamino; aminocarbonylamino; or methylaminocarbonylamino, ethylaminocarbonylamino, propylaminocarbonylamino, i-propylaminocarbonylamino, butylaminocarbonylamino, sec.-butylaminocarbonylamino or i-butylaminocarbonylamino.

The following are examples of alkyl radicals which can be represented by $R^1$ and/or $R^2$: methyl, ethyl, propyl, i-propyl, n-butyl, i-butyl or sec.-butyl; 2-chloroethyl, 2-bromoethyl or 2-cyanoethyl; 2-chloropropyl, 2-bromopropyl, 2-cyanopropyl, 3-chloropropyl, 3-bromopropyl or 3-cyanopropyl; 2-, 3- or 4-chlorobutyl, 2-, 3- or 4-bromobutyl or 2-, 3- or 4-cyanobutyl; 2,3-dihydroxypropyl or 2-hydroxy-3-chloropropyl; 2-acetoxyethyl, 2-propionyloxyethyl, 2-butyryloxyethyl, 2-acetoxypropyl, 2-propionyloxypropyl, 2-butyryloxypropyl, 3-acetoxypropyl, 3-propionyloxypropyl, 3-butyryloxypropyl, 3-acetoxybutyl, 3-propionyloxybutyl, 3-butyryloxybutyl, 4-acetoxybutyl, 4-propionyloxybutyl or 4-butyryloxybutyl; methylaminocarbonyloxethyl, ethylaminocarbonyloxethyl, propylaminocarbonyloxethyl, butylaminocarbonyloxyethyl, methylaminocarbonyloxyprop-3-yl, ethylaminocarbonyloxyprop-3-yl, propylaminocarbonyloxyprop-3-yl, butylaminocarbonyloxyprop-3-yl, methylaminocarbonyloxybut-4-yl, ethylaminocarbonyloxybut-4-yl, propylaminocarbonyloxybut-4-yl or butylaminocarbonyloxybut-4-yl; 2-hydroxyethyl, 2-hydroxypropyl, 3-hydroxypropyl, hydroxyprop-2-yl, 2-, 3- or 4-hydroxybutyl, or 1-, 3- or 4-hydroxybut-2-yl; allyl; methallyl or crotyl; methoxy-ethyl, -prop-3-yl, -but-4-yl, -but-3-yl or -but-2-yl, propoxy-ethyl, -prop-3-yl, -but-4-yl, -but-3-yl or -but-2-yl, or butoxy-ethyl, -prop-3-yl, -but-4-yl, -but-3-yl or -but-2-yl; hydroxyethoxy-ethyl, -prop-3-yl, -but-4-yl, -but-3-yl or -but-2-yl, methoxyethoxy-ethyl, -prop-3-yl, -but-4-yl, -but-3-yl or -but-2-yl, propoxyethoxy-ethyl, -prop-3-yl, -but-4-yl, -but-3-yl or -but-2-yl, butoxyethoxy-ethyl, -prop-3-yl, -but-4-yl, -but-3-yl or -but-2-yl, hydroxyethoxyethoxy-ethyl, -prop-3-yl, -but-4-yl, -but-3-yl or -but-2-yl, methoxyethoxyethoxy-ethyl, -prop-3-yl, -but-4-yl, -but-3-yl or -but-2-yl or ethoxyethoxyethoxy-ethyl, -prop-3-yl, -but-4-yl, -but-3-yl or -but-2-yl; 2,3-dihydroxypropoxy-ethyl, -prop-3-yl, -but-4-yl, -but-3-yl or -but-2-yl; 2-hydroxy-3-chloropropoxyethyl; 2-hydroxy-3-methoxypropyl, 2-hydroxy-3-ethoxypropyl, 2-hydroxy-3-butoxypropyl, 2-hydroxy-3-methoxyethoxypropyl, 2-hydroxy-3-ethoxyethoxypropyl, 2-hydroxy-3-(3-methoxypropoxy)-propyl or 2-hydroxy-3-(4-ethoxybutoxy)-propyl.

The following are examples of radicals which can also be represented by $R^1$: benzyl, phenethyl or phenoxy-ethyl, -prop-3-yl, -but-4-yl, -but-3-yl or -but-2-yl; cyclohexyl or cyclopentyl; methoxy-carbonylethyl, -carbonyl-1-methylethyl or -carbonyl-2-methylethyl, ethoxy-carbonylethyl, -carbonyl-1-methylethyl or -carbonyl-2-methylethyl, propoxy-carbonylethyl, -carbonyl-1-methylethyl or -carbonyl-2-methylethyl, hydroxyethoxy-carbonylethyl, -carbonyl-1-methylethyl or -carbonyl-2-methylethyl, chloroethoxy-carbonylethyl, -carbonyl-1-methylethyl or -carbonyl-2-methylethyl, or methoxyethoxy-carbonylethyl, -carbonyl-1-methylethyl or -carbonyl-2-methylethyl; or 2-acetoxy-ethyl or -propyl, 2-propionyloxy-ethyl or -propyl, 2-butyryloxy-ethyl or -propyl, 3-acetoxy-propyl or -butyl, 3-propionyloxy-propyl or -butyl, 3-butyryloxy-propyl or -butyl, or 4-acetoxybutyl, 4-propionyloxybutyl or 4-butyryloxybutyl.

Large numbers of bases are known which are present as discharging agents in the discharge reserve printing paste and which produce a pH value of at least 8 in a 5% strength aqueous solution. Examples of such bases are the hydroxides of the alkali and alkaline earth metals, salts of alkaline earth and alkali metals with weak organic or inorganic acids, such as, for example, an alkali metal acetate or alkali metal carbonates or bicarbonates, trialkali metal phosphates, ammonia or aliphatic amines, such as, for example, triethylamine, tripropylamine or tributylamine, ethanolamine, dimethylethanolamine or diethylethanolamine, diethanolamine, methyldiethanolamine, ethyldiethanolamine or propyldiethanolamine or triethanolamine. The bases which are usually employed are alkaline earth metal hydroxides, such as, for example, calcium hydroxide, alkali metal hydroxides, such as, for example, sodium hydroxide or potassium hydroxide, or alkali metal salts of weak inorganic acids, such as, for example, sodium carbonate or trisodium phosphate. Sodium hydroxide or potassium hydroxide or, in particular, sodium carbonate or bicarbonate or potassium carbonate or bicarbonate, are preferably used as the base in the discharge reserve printing pastes. Mixtures of different bases can also be used. The concentration of the base in the discharge reserve printing pastes is appropriately 25 to 250 g/kg, preferably 50 to 130 g/kg. In addition to the said bases, the discharge reserve printing pastes contain the additives usually present in textile printing pastes, in particular thickeners, such as, for example, alginates, starch products, synthetic polymeric thickeners, mineral oils and hydrotropic substances, such as, for example, urea, and also additives which promote wetting, penetration and absorption of dyestuff. The presence of nonionic detergents, which are appropriately present in the discharge reserve printing pastes, such as, for example, glycerol and/or polyglycols, such as polyethylene glycol hving an average molecular weight of 300 to 400, is particularly advantageous for the discharging process.

In the process according to the invention it is preferable to employ a dyestuff in which $X^1$ denotes methylsulphonyl, ethylsulphonyl or trifluoromethyl and, in particular, cyano, nitro or alkoxycarbonyl having 1 to 4 C atoms in the alkoxy radical, preferably methoxycarbonyl, or ethoxycarbonyl, and/or $X^2$ denotes methylsulphonyl or ethylsulphonyl and, in particular, nitro or cyano, and/or $X^3$ denotes alkylsulphonyl having 1 to 4 C atoms, phenylsulphonyl which is optionally substituted by chlorine, bromine or methyl, cyano, nitro and, in particular, alkoxycarbonyl which has 1 to 4 C atoms in the alkoxy radical and which is optionally substituted by hydroxyl, methoxy, ethoxy or methoxyethoxy, or, in particular, aminosulphonyl or alkylaminosulphonyl which has 1 to 4 C atoms and in which the alkyl group can optionally be substituted by hydroxyl, methoxy, ethoxy or methoxyethoxy.

It is particularly preferable to use dyestuffs of the formula I which carry the preferred radicals indicated above as 2 or 3 of the substituents of $X^1$, $X^2$ and $X^3$, but not more than 2 radicals of $X^1$, $X^2$ or $X^3$ may be alkoxycarbonyl radicals.

Preferred $X^1/X^2$ combinations are nitro/methylsulphonyl, nitro/ethylsulphonyl, nitro/trifluoromethyl, cyano/methylsulphonyl, cyano/ethylsulphonyl, methylsulphonyl/methylsulphonyl or ethylsulphonyl/ethylsulphonyl.

$X^1/X^2$ combinations which are very particularly preferred are nitro/cyano, nitro/nitro, nitro/methoxycarbonyl, nitro/ethoxycarbonyl or cyano/cyano.

Preferred $X^1/X^2/X^3$ combinations are methylsulphonyl/methylsulphonyl/alkoxycarbonyl, ethylsulphonyl/ethylsulphonyl/alkoxycarbonyl, nitro/methylsulphonyl/alkoxycarbonyl and nitro/ethylsulphonyl/alkoxycarbonyl, and the alkoxy radical of the alkoxycarbonyl group carries 1 to 4 C atoms which are optionally substituted.

$X^1/X^2/X^3$ combinations which are very particularly preferred are nitro/cyano/nitro, nitro/nitro/nitro, nitro/nitro/cyano, nitro/methoxycarbonyl/nitro, nitro/ethoxycarbonyl/nitro, nitro/cyano/optionally substituted alkoxycarbonyl, nitro/nitro/optionally substituted alkoxycarbonyl, cyano/cyano/optionally substituted alkoxycarbonyl, nitro/nitro/aminosulphonyl, nitro/nitro/optionally substituted alkylaminosulphonyl, nitro/cyano/aminosulphonyl, nitro/cyano/optionally substituted alkylaminosulphonyl, cyano/cyano/aminosulphonyl or cyano/cyano/optionally substituted alkylaminosulphonyl.

A further preferred group of dyestuffs of the formula I includes dyestuffs which carry one or more hydroxyl groups in the radicals $R^1$ and $R^2$ and/or in the alkyl or alkoxy radicals represented by $Y^1$ or $Y^2$ and/or in the alkyl radicals represented by Z. In this connection, the 2-hydroxyethyl radical and the 2,3-dihydroxypropyl radical are particularly preferred. Dyestuffs which are also particularly preferred are those in which the radicals $R^1$ and/or $R^2$ and/or the alkyl or alkoxy radicals represented by $Y^1$, $Y^2$ or Z, represent $(CH_2)_m(OCH_2CH_2)_nOH$, it being possible for m to assume the values 2 to 4 and for n to assume the values 1 to 3, the values of m and n being selected in such a way that the group contains not more than 8 C atoms.

Further radicals which are preferred are, in the case of $R^1$ and $R^2$, alkyl radicals having 3 to 8 C atoms, in the case of Z, alkyl radicals having 2 to 8 C atoms and, in the case of $Y^1$ and $Y^2$, alkoxy radicals having 3 to 8 C atoms, the carbon chain of the alkyl and alkoxy radicals being interrupted by 1 to 3 oxygen atoms and being optionally substituted by hydroxyl. Preferred dyestuffs are also those of the general formula I which carry alkoxycarbonylalkyl groups in the radicals $R^1$, $Y^1$, $Y^2$ and Z. Radicals which are particularly preferred in this connection are alkoxycarbonylmethyl, ethoxycarbonylethyl or alkoxycarbonylmethylethyl in the case of $R^1$ and alkoxycarbonyl or alkoxycarbonylalkyl having 1 to 4 C atoms in the alkyl group in the case of Z.

The process according to the invention is preferentially suitable for textile materials consisting of water-repellent fibres, particularly polyester fibres. However, it is also suitable for textile materials containing water-repellent fibres to a predominant extent in addition to other fibres, such as, for example, staple rayon or cotton.

The disperse dyestuffs of the formula I which are dischargeable to white can be applied to the textile material in the form of dye liquors or printing pastes. The textile material is then impregnated with the dye liquor in a manner which is in itself known, for example padded or slop-padded. The dye liquors can in this case contain one or more disperse dyestuffs of the formula I in addition to the known customary dyeing auxiliaries, such as, for example, dispersing agents, wetting agents, anti-foaming agents and padding auxiliaries. The impregnated fabric web is squeezed out to a liquor pick-up of 50 to 120%. The fabric webs are then dried by means of warm air, if desired preceded by infrared irradiation, the temperature being approx. 80° C. or up to a maximum of about 90° C., the time being shortened correspondingly. The fabric webs prepared in this way are then printed with a discharge reserve printing paste containing, as the discharging agent, one of the bases described in greater detail above and also the known additives which are customary in printing pastes for textile printing, particularly thickeners. The impregnated and printed fabric webs are then subjected to a heat treatment at a temperature between 100° and 230° C. Within the lower temperature range of about 100° to 110° C., the supply of heat is preferably effected by means of superheated steam. For heat treatments which are carried out at temperatures between 160° and 230° C. it is preferable to use hot air as the heat transfer agent. After the heat treatment, which has the effect of fixing the disperse dyestuffs of the formula I at the areas which have not been after-printed with the discharge reserve printing paste and also destroying the disperse dyestuffs of the formula I at the areas which have been printed with the discharge reserve printing paste, the textiles are subjected to an after-treatment in the manner customary for polyester and are given a hot and cold rinse and dried.

A particular embodiment of the process according to the invention consists in the dye liquor containing not only disperse dyestuffs of the formula I but also one or more disperse dyestuffs which are resistant go alkali and are therefore not destroyed by the alkaline discharge reserve printing pastes which are to be employed in accordance with the invention. Multi-coloured designs are obtained if the procedure followed is in other respects as indicated above.

As already mentioned, it is also possible to print the disperse dyestuffs of the formula I on the fabric in the form of printing pastes and then to after-print with the discharge reserve printing paste. The textile prints are then fixed and finished as already described above. In this process too it is possible to add one or more disperse dyestuffs which are resistant to alkali to the dyestuff printing paste which is printed on initially and which can also contain several disperse dyestuffs of the formula I. Multi-coloured designs are also obtained in this case. A further possible means of carrying out the process according to the invention consists in printing discharge reserve printing pastes which, in turn, contain disperse dyestuffs resistant to alkali, on the ground which has been impregnated or printed with disperse dyestuffs of the formula I. Here too, multi-coloured designs are obtained when the textile materials are subsequently fixed and finished as described above.

The process according to the invention makes it possible to apply discharge reserve prints not only to textile materials consisting of water-repellent fibres, particularly polyester fibres, or mainly containing such fibres, but also to textile materials containing water-repellent fibres, particularly polyester fibres, and cellulose fibres in comparable proportions. Polyester/cellulose mixed fabrics of this type can, for example, have a ratio by weight of polyester/cellulose of 75:25, 65:35 or 50:50. Discharge reserve prints can be applied to mixed fabrics of this type by the process according to the invention if the dye liquor or printing paste, which contains at least one disperse dyestuff of the formula I which is dischargeable to white and, optionally, one or more disperse dyestuffs which are resistant to discharging agents, also contains, in addition, at least one dischargeable reactive dyestuff containing a reactive radical of the formula $$-SO_2-CH_2-CH_2-Hal \quad \text{(II) or}$$

$$-SO_2-CH_2-CH_2-O-SO_3X \quad \text{(III) or}$$

$$-NH-SO_2-CH_2-CH_2-OSO_3X \quad \text{(VI) or}$$

$$-SO_2-CH=CH_2 \quad \text{(V),}$$

wherein X denotes hydrogen or a metal cation, particularly the sodium cation, and Hal denotes halogen, particularly chlorine or bromine, and, if appropriate, one or more reactive dyestuffs which are resistant to discharging, and if the discharge reserve printing paste contains an alkali metal sulphite or alkali metal bisulphite and optionally an aldehyde in addition to an alkali metal carbonate or alkali metal bicarbonate, and if the procedure is carried out in other respects as already indicated.

The dischargeable reactive dyestuffs which are to be employed contain one of the fibre-reactive radicals of the formulae II to V indicated above. It is common to the radicals of the formulae II to IV that they form a vinylsuphonyl group in the presence of alkali by splitting off a sulphate or halide anion. This group, which is formed in the presence of alkali, becomes fixed on cotton or staple rayon in the same manner as the vinylsulphonyl radical of the formula V which is directly linked to the dyestuff radical, as a result of an addition reaction of an OH group of the cellulose with the vinyl double bond. Dischargeable reactive dyestuffs containing one of the reactive radicals mentioned above can belong to any of the industrially important groups of dyestuffs. The monoazo dyestuffs C.I. Yellow 13 to 17 and 72 to 74, Orange 7, 15, 16, 23, 24 and 55, Red 21 to 23, 35, 36, 50, 63, 103 to 107, and 112 to 114, Blue 28 and Brown 16; the disazo dyestuffs C.I. Blue 76, Blue 98 or Black 5 or 31; the monoazo or disazo metal complex dyestuffs C.I. Violet 4 or 5, Blue 20 or Brown 18; the anthraquinone dyestuffs C.I. Violet 22 or Blue 19 and 27; and the phthalocyanine dyestuffs C.I. Blue 21, 38, 77 or 91 and Green 14 are mentioned as examples of suitable reactive dyestuffs. Dischargeable reactive dyestuffs which are particularly preferred are those which contain, as the reactive anchor, at least one fibre-reactive radical of the formulae III or IV.

The quantities of the disperse and reactive dyestuffs present in the padding liquors or printing pastes when mixed fabrics are treated, are adjusted in the customary manner to suit the depth of colour of the desired dyeing and the intensity of the reactive effect. In addition, the quantity of dyestuffs suitable for one of the types of fibre involved also corresponds to the proportion by weight of this type of fibre to the total weight of fibres. Thus, for example, a padding liquor which is prepared for a ground dyeing of a certain colour shade will contain a high proportion of dischargeable and, if appropriate, non-dischargeable reactive dyestuffs and a low proportion of dischargeable and, if appropriate, non-dischargeable disperse dyestuffs if the mixed fabric contains mainly cellulose fibres, and will contain a high proportion of disperse dyestuffs, or exclusively disperse dyestuffs, and a low proportion of reactive dyestuffs, or no reactive dyestuffs, if the substrate contains mainly polyester fibres.

If, when carrying out the process according to the invention, the padding liquor or printing paste, in addition to one or more dischargeable disperse dyestuffs of the formula I, also contains one or more dischargeable reactive dyestuffs containing reactive radicals of the formulae II to V, a discharge reserve printing paste will be used which, in addition to an alkali metal carbonate or bicarbonate, also contains an alkali metal sulphite or bisulphite as the reserving agent for the reactive dyestuffs. The alkali metal bisulphite can also be replaced, wholly or partially, by an equivalent quantity of an alkali metal bisulphite/aldehyde adduct. It is also possible to produce this adduct in the reserving paste itself, by adding an alkali metal bisulphite, an alkali metal bicarbonate and an aldehyde to the reserving paste. Alkali metal sulphites, bisulphites and bicarbonates which are suitable for use in industry are, in particular, the sodium or potassium salts, preferably the sodium salts. Suitable aldehydes which can be present in the form of alkali metal bisulphite adducts in the reserving pastes are, in principle, any aldehyde which is readily accessible on an industrial scale, such as, for example, formaldehyde, acetaldehyde, glyoxal or benzaldehyde. Since the aldehyde/alkali metal bisulphite adducts are in equilibrium with the individual components of the adduct, preferred aldehydes are those which do not have an excessively high vapour pressure in the free state and thus cannot give rise to odour nuisance. Glyoxal, for example is particularly suitable for use in accordance with the invention.

The use of separately prepared addition compounds of these two components offers particular advantages in the preparation of printing pastes containing sodium bisulphite in combination with an aldehyde. Thus, for example, the use of such an adduct eliminates the troublesome foaming which can occur in unfavourable cases when printing pastes containing an alkali metal bicarbonate are being prepared. The concentration of the total of the reserving agents in the printing pastes is appropriately 25 to 250 g/kg, preferably 50 to 130 g/kg.

Disregarding the different composition of the padding liquor or printing paste and of the discharge reserve printing paste, the process stages when producing discharge reserve prints on polyester/cellulose mixed fabrics are the same as in the treatment of fabrics consisting of polyester or containing mainly polyester. However, when producing discharge reserve prints on polyester/cellulose mixed fabrics, it is appropriate to subject the padded and printed textile sheet-like structures to a heat treatment at a temperature between 100° and 190° C., and preferably to supply the heat for this treatment by means of super-heated steam, after the fabric has been padded or printed, dried or incipiently dried and then after-printed with the discharge reserve printing paste. The effect of the heat treatment is (a) to inhibit the dischargeable disperse and reactive dyestuffs at the areas which have been printed with the discharge reserve printing paste and to fix any non-reservable disperse and reactive dyestuffs which may be present, and (b) to fix the disperse dyestuffs at the areas which have not been printed with discharge reserve printing paste, and also, if the padding liquor or printing paste contained an alkali metal formate, simultaneously to fix the reactive dyestuffs. In this connection, inhibition of the dyestuff is to be understood as meaning the change in the dyestuff molecule, which is caused by the reserving agent and which results in the dyestuff concerned no longer dyeing the substrate. In the two-phase process, that is to say if the padding liquor or printing paste did not contain an alkali metal formate, the reactive dyestuffs are then fixed in a manner which is in itself known in the ground dyeing, that is to say at the areas which have not been printed with discharge reserve printing paste. Finally, the dyeings and/or prints on the mixed fabrics are subjected to a hot and cold rinse and are dried.

A particular embodiment of the process according to the invention on mixed fabrics consists in a procedure in which, besides dischargeable disperse and reactive dyestuffs, the padding liquor or printing paste additionally contains disperse and reactive dyestuffs which are resistant to discharging and which are therefore not destroyed by the discharge reserve printing pastes to be employed in accordance with the invention. Multi-coloured designs are obtained if the procedure followed is in other respects as indicated above. A further possible means of carrying out the process according to the invention in the case of mixed fabrics consists in printing, on the ground which has been padded or printed with reservable dyestuffs, discharge reserve printing pastes which, in turn, contain disperse and reactive dyestuffs which are resistant to the reserving agent. Here too, multi-coloured designs are obtained if the textile materials are subsequently fixed and finished as described above.

The disperse dyestuffs of the formula I, which are dischargeable to white, are preferably applied to the fabric by impregnation with a padding liquor.

The disperse dyestuffs of the formula I are present in the padding liquors or in the printing pastes in a finely dispersed form, such as is customary and known for disperse dyestuffs, while any reactive dyestuffs which may be present are dissolved. The preparation of the padding liquors or printing pastes which are to be employed in the process according to the invention is also effected in a manner which is in itself known by mixing the constituents of the liquors or printing pastes, respectively, with the necessary quantity of water and liquid, finely disperse or solid, redispersible formulations of the disperse dyestuffs and also solutions or formulations of the reactive dyestuffs and also solutions or formulations of the reactive dyestuffs.

Alakli-resistant disperse dyestuffs which can be combined with the dyestuff of the formula I in order to produce multi-coloured designs, are the known commercial dyestuffs belonging to the group comprising the azo or azomethine, quinophthalone, nitro or anthraquinone dyestuffs. The following are a few examples of alkali-resistant disperse dyestuffs:

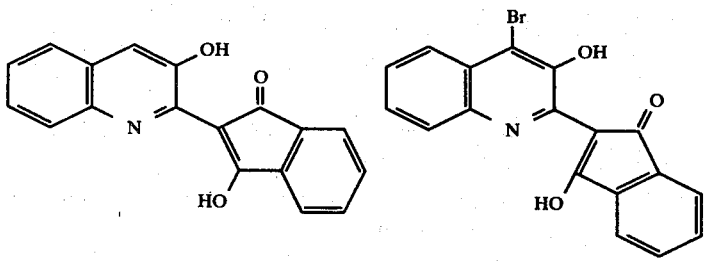

-continued

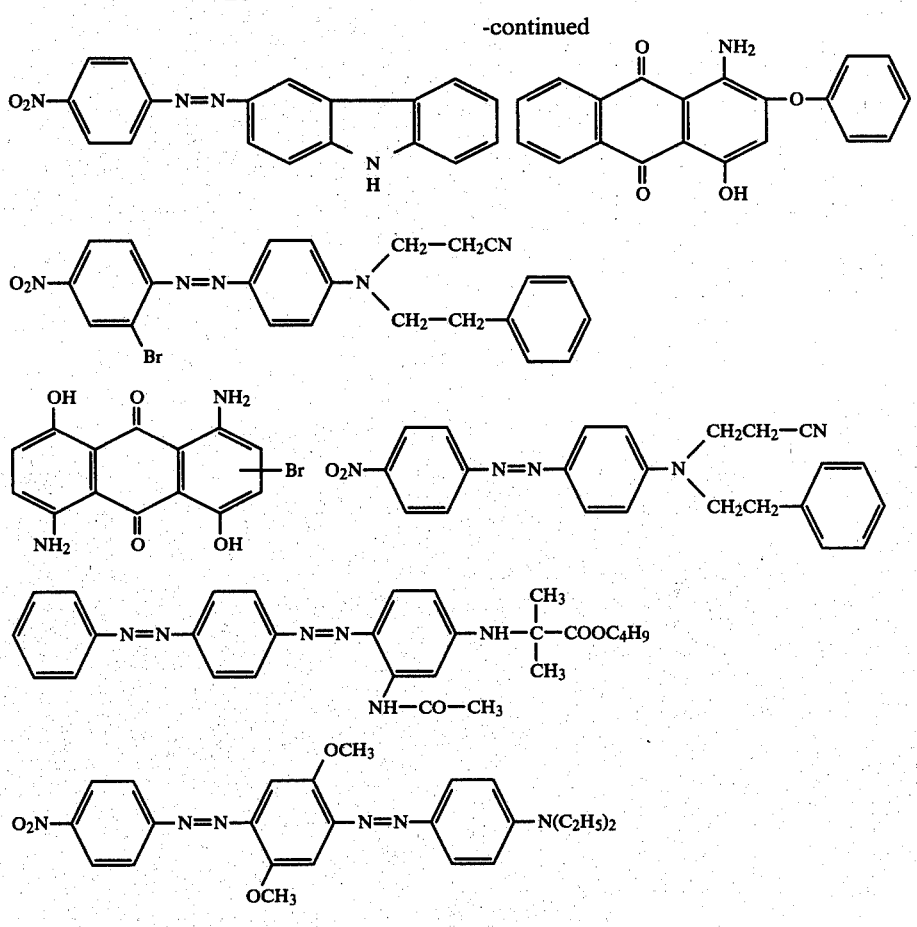

Reactive dyestuffs which are resistant to the reserving agent and which can be combined with the dischargeable reactive dyestuffs for the production of multi-coloured designs on polyester/cellulose mixed fabrics, are the known commercial dyestuffs belonging to the group comprising the azo or azomethine, quinophthalone, nitro or anthraquinone dyestuffs which contain, as the fibre-reactive radical, a radical belonging to the class comprising the triazines, quinoxalines, phthalazines, pyridazines, pyrimidines or $\alpha,\beta$-unsaturated aliphatic carboxylic acids. The following text lists, as representatives of the whole class, the most important compounds from which the fibre-reactive radicals of the reactive dyestuffs which are resistant to the discharging agent are derived:

Cyanuric chloride, cyanuric bromide, cyanuric fluoride, dihalogenomonoaminotriazines, such as 2,6-dichloro-4-aminotriazine, 2,6-dichloro-4-methylaminotriazine, 2,6-dichloro-4-oxyethylaminotriazine, 2,6-dichloro-4-phenylaminotriazine, 2,6-dichloro-4-(o-, m- or p-sulphophenyl)-aminotriazine, dihalogenoalkoxy symmetrical triazines, dihalogenoaryloxy symmetrical triazines, tetrahalogenopyrimidines, 2,4,6-trihalogenopyrimidines, derivatives of heterocyclic carboxylic or sulphonic acids, such as 3,6-dichloropyridazine-4-carboxylic acid chloride, 2,4-dichloropyrimidine-5-carboxylic acid chloride, 2,4,6-trichloropyrimidine-5-carboxylic acid chloride, 4,5-dichloro-6-pyridazonylpropionyl chloride, 1,4-dichlorophthalazine-6-carboxylic acid chloride, 5,6-dichloro-4-methyl-2-methylsulphonylpyrimidine, 2-monochloroquinoxaline-6-carboxylic or -6-sulphonic acid chloride, 3-monochloroquinoxaline-6-carboxylic or -6-sulphonic acid chloride, 2,3-dichloroquinoxaline-6-carboxylic or -6-sulphonic acid chloride, 1,4-dichlorophthalazine-6-carboxylic or -6-sulphonic acid chloride, 2,4-dichloroquinazoline-6-carboxylic or -6-sulphonic acid chloride, 2,4-dichloroquinazoline-7-carboxylic or -7-sulphonic acid chloride, 2-chlorobenzthiazole-5-carboxylic or -5-sulphonic acid chloride, 2-chlorobenzthiazole-6-carboxylic or -6-sulphonic acid chloride, 2-methylsulphonylbenzthiazole-5-sulphonic acid chloride, 2-methylsulphonylbenzthiazole-6-sulphonic acid chloride, 2-ethylsulphonylbenzthiazole-5-sulphonic acid chloride, 2-ethylsulphonylbenzthiazole-6-sulphonic acid chloride, 2-phenylsulphonylbenzthiazole-5-sulphonic acid chloride, 2-phenylsulphonylbenzthiazole-6-sulphonic acid chloride, acryloyl chloride and 3-chloropropionyl chloride.

Insofar as solutions of substances are employed in the illustrative embodiments which follow, these are aqueous solutions, unless another solvent is expressly specified. Percentages are percentages by weight.

The disperse dyestuffs of the formula I which are to be employed in accordance with the invention are, to a very large extent already known, for example from German Offenlegungsschriften Nos. 1,290,915, 1,719,066, 1,809,920 and 1,962,402, French Patent Specifications Nos. 145,833, 865,904, 816,950 and 1,465,508 and the Journal of the Chemical Society, Perkin I, 1979, page 2,634.

The disperse dyestuffs of the formula I can be prepared in a manner which is in itself known by diazotisation and coupling, as described, for example, in Swiss Patent Specification No. 615,938 or in German Auslegeschrift No. 1,644,144. Some of the disperse dyestuffs of the general formula I can also be prepared in a manner which is in itself known by diazotising an amine of the formula VI

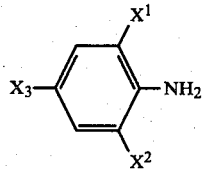

(VI)

in which $X^1$ denotes chlorine, bromine, nitro, cyano, alkylsulphonyl having 1 to 4 C atoms or phenylsulphonyl and $X^2$ denotes chlorine or bromine, and coupling the product with an amine of the formula VII

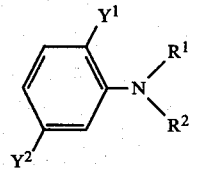

(VIII)

and, in the dyestuff of the formula VIII

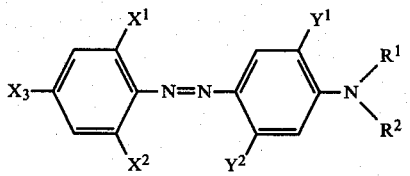

(VIII)

thus obtained, in which $X^1$ denotes chlorine, bromine, nitro, cyano, alkylsulphonyl having 1 to 4 C atoms or phenylsulphonyl and $X^2$ denotes chlorine or bromine, replacing the radical which represents chlorine or bromine by cyano, nitro, alkylsulphonyl having 1 to 4 C atoms, arylsulphonyl or dialkylphosphono having 1 to 4 C atoms in the alkyl radical. Replacement by cyano is described in German Offenlegungsschriften Nos. 1,290,915 and 1,962,402. Replacement by nitro is described in German Offenlegungsschriften Nos. 1,962,402, 1,809,920 and 1,807,642. Replacement by alkylsulphonyl/arylsulphonyl is described in German Offenlegungsschriften Nos. 1,962,402 and 2,905,274. Replacement by dialkylphosphono is described in the Journal of the Chemical Society, Perkin I, 1979, page 2,634.

In the examples which follow, unless otherwise specified, parts are parts by weight and percentages are percentages by weight.

EXAMPLE 1

10 parts of the dyestuff of the formula

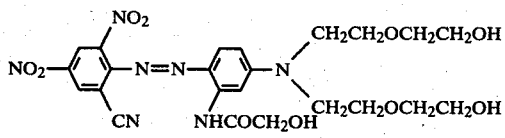

are added, in a finely divided state, to a padding liquor containing, per 1,000 parts, 905 parts of water, 5 parts of citric acid and 60 parts of a polymerisation product based on acrylic acid, as an anti-migration agent. This padding liquor is used to pad a polyester fabric based on polyethylene glycol terephthalate, at 20° to 30° C., with a squeezing out effect of approx. 80%. The padded fabric is dried carefully at 60° to 80° C. After it has been dried, it is after-printed with a printing paste containing, per 1,000 parts, 500 parts of an aqueous 10% strength locust bean flour ether thickener, 260 parts of water, 80 parts of calcined sodium carbonate, 80 parts of polyethylene glycol 400 and 80 parts of glycerol. After fixing with superheated steam for 7 minutes at 175° C., reductive after-treatment, soaping and subsequent rinsing and drying, a blue print which has very good fastness properties, above all good fastness to light, fixing by dry heat, rubbing and washing, is obtained. A very good white ground with sharp outlines is obtained at the areas which have been printed with the printing paste containing sodium carbonate.

EXAMPLE 2

20 parts of the dyestuff

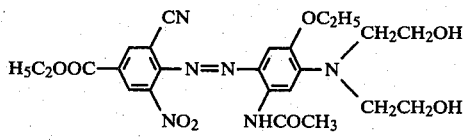

are used instead of the dyestuff in Example 1 and the procedure followed is in other respects as indicated in Example 1. This gives a blue print which has very good tinctorial properties, in particular good fastness to light, fixing by dry heat, rubbing and washing, and a very good white ground with sharp outlines at the discharged areas.

EXAMPLE 3

20 parts of the dyestuff of the formula

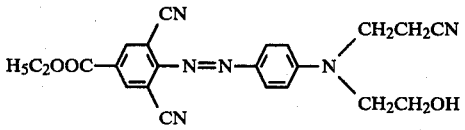

are used instead of the dyestuff in Example 1 and the procedure followed is in other respects as indicated in Example 1. This gives a red print which has very good tinctorial properties, in particular good fastness to light, fixing by dry heat, rubbing and washing, and a very good white ground with sharp outlines.

EXAMPLE 4

30 parts of the dyestuff of the formula

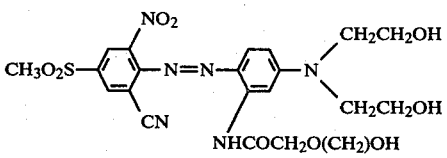

are used instead of the dyestuff in Example 1 and the procedure followed is in other respects as indicated in Example 1. This gives a reddish-tinged blue print which has very good tinctorial properties, in particular good fastness to light, fixing by dry heat, rubbing and washing, and a very good white ground with sharp outlines.

EXAMPLE 5

20 parts of the dyestuff of the formula

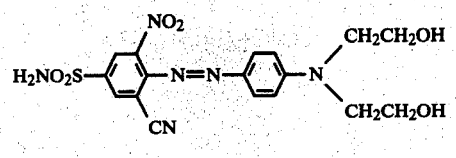

are used instead of the dyestuff in Example 1 and the procedure followed is in other respects as indicated in Example 1. This gives an orange-coloured print which has very good tinctorial properties, in particular good fastness to light, fixing by dry heat, rubbing and washing, and a very good white ground with sharp outlines.

EXAMPLE 6

A mercerised mixed fabric composed of 65:35 polyester/cotton is padded with a mixture consisting of 100 parts of a 20% strength liquid formulation of the dyestuff of the formula

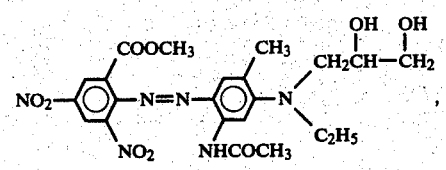

40 parts of the liquid commercial form of C.I. Reactive Blue 122, 808 parts of cold water, 10 parts of sodium m-nitrobenzenesulphonate, 20 parts of an anti-migration agent based on polyacrylic acid, 2 parts of monosodium phosphate and 20 parts of sodium formate.

The fabric is dried carefully in a hot flue at 80°–100° C. and is after-printed by the screen printing process, using a printing paste composed of 25 parts of the commercial form of 1-[5-(3,6-dichloropyridazin-4-ylcarbonylamino)-2-methyl-3-sulphophenyl]-3-carboxyl-4-(2-sulphophenylazo)-5-pyrazol-5-one, 40 parts of the liquid commercial form of C.I. Disperse Yellow 63, 150 parts of urea, 199 parts of cold water, 10 parts of sodium m-nitrobenzenesulphonate, 500 parts of a stock thickener, 40 parts of sodium bicarbonate, 30 parts of 38° Be sodium bisulphite solution and 6 parts of 40% strength glyoxal solution. The stock thickener consists of 230 parts of an aqueous 4% strength alginate thickener, 80 parts of an aqueous 10% strength starch ether thickener, 85 parts of water, 25 parts of an aqueous 10% strength solution of the condensation product formed from polyglycol 2,000 and stearic acid, and 80 parts of a high-boiling petroleum fraction.

After drying, fixing is carried out for 7 minutes at 175° C. with superheated steam and after-treatment is carried out as indicated in Example 1.

Yellow coloured effects on a blue ground are obtained.

Discharge reserve prints which have very good tinctorial properties are also obtained if, in Examples 1 to 6, equivalent quantities of the disperse dyestuffs indicated in the table below are used instead of the disperse dyestuffs indicated in these examples.

TABLE

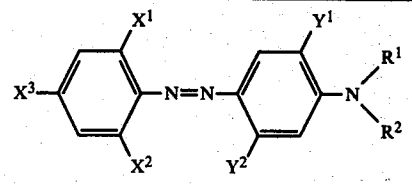

| $X^1$ | $X^2$ | $X^3$ | $Y^1$ | $Y^2$ | $R^1$ | $R^2$ | shade |
|---|---|---|---|---|---|---|---|
| $NO_2$ | CN | $NO_2$ | H | $NHCOCH_2O(CH_2)_2OH$ | $CH_2CH(OH)CH_2(OH)$ | $C_2H_5$ | 1 |
| $NO_2$ | CN | $NO_2$ | H | $NHCOCH_2OH$ | $(CH_2)_2OCOCH_3$ | $(CH_2)_2OCOCH_3$ | 1 |
| $NO_2$ | CN | $NO_2$ | H | $NHCOCH_2O(CH_2)_2OCH_3$ | $CH_2CH{=}CH_2$ | $(CH_2)_2OH$ | 1 |
| $NO_2$ | CN | $NO_2$ | H | $NHCOOCH_3$ | $(CH_2)_2CN$ | $(CH_2)_2OCOCH_3$ | 2 |
| $NO_2$ | CN | $NO_2$ | H | $NHCONHC_6H_5$ | $(CH_2)_2COOCH_3$ | n-$C_3H_7$ | 1 |
| $NO_2$ | CN | $NO_2$ | $OCH_3$ | $NHCOC_2H_5$ | $(CH_2)_2OCOCH_3$ | $(CH_2)_2OCOCH_3$ | 1 |
| $NO_2$ | CN | $NO_2$ | $OCH_3$ | $NHCOCH_2OH$ | $(CH_2)_2COOCH_3$ | $CH_2CH{=}CH_2$ | 1 |
| $NO_2$ | CN | $NO_2$ | $OC_2H_5$ | $NHCOCH_2OH$ | $(CH_2)_2CN$ | $(CH_2)_2OH$ | 1 |
| $NO_2$ | CN | $NO_2$ | $O(CH_2)_2OCH_3$ | $NHCOCH_3$ | $[(CH_2)_2O]_2H$ | $[(CH_2)_2O]_2H$ | 1 |
| $NO_2$ | CN | $NO_2$ | $O(CH_2)_2OH$ | $O(CH_2)_2OH$ | H | $[(CH_2)_2O]_2CH_3$ | 1 |
| $NO_2$ | CN | $NO_2$ | $O[(CH_2)_2O]_2H$ | $NHCO(CH_2)_2Cl$ | $[(CH_2)_2O]_2H$ | $[(CH_2)_2O]_2H$ | 1 |
| $NO_2$ | CN | $NO_2$ | $CH_3$ | $NHCOC_2H_5$ | $CH_2CH(OH)CH_2(OH)$ | H | 1 |
| $NO_2$ | CN | $NO_2$ | $CH_2OH$ | $CH_2OH$ | $(CH_2)_3OH$ | $(CH_2)_3OH$ | 1 |
| $NO_2$ | CN | $NO_2$ | Cl | $NHCOC_6H_5$ | $(CH_2)_2OH$ | H | 1 |
| $NO_2$ | CN | $NO_2$ | H | $CH_3$ | $(CH_2)_2OH$ | $(CH_2)_2CN$ | 2 |
| $NO_2$ | CN | $NO_2$ | H | $CH_3$ | $(CH_2)_2OCOCH_2C_6H_5$ | $(CH_2)_2OH$ | 2 |
| $NO_2$ | CN | $NO_2$ | H | $C_2H_5$ | $(CH_2)_2OCONHCH_3$ | $(CH_2)_2OCONHCH_3$ | 2 |
| $NO_2$ | CN | $NO_2$ | H | $O(CH_2O)_2C_2H_5$ | $CH_2C_6H_5$ | $(CH_2)_2OH$ | 2 |
| $NO_2$ | CN | $NO_2$ | H | Cl | $CH_2CH(OH)CH_2OCH_3$ | H | 3 |
| $NO_2$ | CN | $NO_2$ | $CH_3$ | H | $CH_2CH(OH)CH_2(OH)$ | H | 2 |
| $NO_2$ | CN | $NO_2$ | $OCH_3$ | H | $[(CH_2)_2O]_3H$ | H | 2 |
| $NO_2$ | CN | $NO_2$ | Cl | H | $(CH_2)_2OH$ | H | 3 |
| $NO_2$ | CN | $NO_2$ | H | $NHCO(CH_2)_2O(CH_2)_2OH$ | $(CH_2)_2CN$ | $[(CH_2)_2O]_2H$ | 1 |
| $NO_2$ | $SO_2CH_3$ | $NO_2$ | H | $NHCOCH_3$ | $(CH_2)_2COOCH_3$ | $C_2H_5$ | 1 |
| $NO_2$ | $SO_2CH_3$ | $NO_2$ | H | $NHCOCH_2OH$ | $(CH_2)_2OCH_3$ | $(CH_2)_2OCH_3$ | 1 |
| $NO_2$ | $SO_2CH_3$ | $NO_2$ | H | $NHCOOC_2H_5$ | $CH_2CH(OH)CH_2OH$ | $(CH_2)_2OH$ | 2 |
| $NO_2$ | $SO_2CH_3$ | $NO_2$ | Cl | H | $(CH_2)_2COOC_2H_5$ | H | 4 |
| $NO_2$ | CN | $COOCH_3$ | H | H | $CH_2CH(OH)CH_2OH$ | $(CH_2)_2CN$ | 4 |
| $NO_2$ | CN | $COOCH_3$ | $O(CH_2)_2OCOCH_3$ | H | $(CH_2)_2OCOCH_3$ | $(CH_2)_2OCOCH_3$ | 4 |
| $NO_2$ | $NO_2$ | $COOC_2H_5$ | $O(CH_2)_2OCH_3$ | $NHCOCH_3$ | $(CH_2)_2OCOC_2H_5$ | $(CH_2)_2OCOC_2H_5$ | 1 |
| $NO_2$ | $SO_2C_6H_5$ | CN | H | H | $(CH_2)_2COOC_2H_5$ | $(CH_2)_2CN$ | 3 |
| $SO_2CH_3$ | CN | $NO_2$ | H | $NHCOCH_2OCH_3$ | $C_2H_5$ | $CH_2CH(OH)CH_2Cl$ | 1 |
| $SO_2CH_3$ | CN | $COOCH_3$ | H | $NHCOCH_2O(CH_2)_2OC_6H_5$ | $CH_3$ | $(CH_2)_2OH$ | 1 |
| $SO_2CH_3$ | CN | $COOC_2H_5$ | H | $NHCOCH_2CN$ | $[(CH_2)_2O]_2C_2H_5$ | $[(CH_2)_2O]_2C_2H_5$ | 1 |
| $SO_2CH_3$ | CN | $SO_2NH_2$ | H | $NHCOCH_2Br$ | $C_3H_7$ | $(CH_2)_2OH$ | 4 |
| $SO_2C_6H_5$ | CN | $NO_2$ | H | $NHCO(CH_2)_3OH$ | $(CH_2)_4OH$ | $(CH_2)_4OH$ | 1 |
| $SO_2CH_3$ | $SO_2CH_3$ | $COOC_2H_5$ | H | $NHCOCH_3$ | $(CH_2)_2OCOCH_3$ | $(CH_2)_2OCOCH_3$ | 1 |
| $SO_2CH_3$ | $SO_2CH_3$ | $NO_2$ | H | Cl | $(CH_2)_2COOCH_3$ | $(CH_2)_2C_6H_5$ | 3 |
| $NO_2$ | CN | $SO_2CH_3$ | $O(CH_2)_2OCH_3$ | $O(CH_2)_2OCH_3$ | $(CH_2)_2CN$ | $(CH_2)_2OH$ | 1 |
| $NO_2$ | CN | $SO_2CH_3$ | H | $NHCONH_2$ | $CH_2CH{=}CH_2$ | $CH_2CH{=}CH_2$ | 1 |
| $NO_2$ | CN | $SO_2C_6H_5$ | H | $NHCOCH_2C_6H_5$ | $C_2H_5$ | $(CH_2)_2OCOC_2H_5$ | 1 |
| $SO_2CH_3$ | $NO_2$ | $SO_2CH_3$ | H | H | $(CH_2)_2COOCH_3$ | $(CH_2)_2CN$ | 3 |
| $COOCH_3$ | $NO_2$ | $SO_2CH_3$ | H | $NHCOC_6H_5$ | $(CH_2)CH(OCH_3)CH_3$ | $(CH_2)_2OH$ | 2 |

TABLE-continued

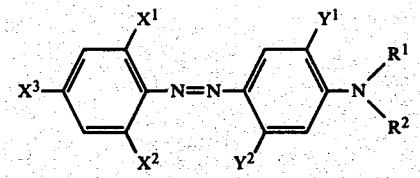

| $X^1$ | $X^2$ | $X^3$ | $Y^1$ | $Y^2$ | $R^1$ | $R^2$ | shade |
|---|---|---|---|---|---|---|---|
| $NO_2$ | $NO_2$ | $SO_2CH_3$ | $O(CH_2)OH$ | $NHCOCH_3$ | $CH(CH_3)CH_2(OH)CH_3$ | $(CH_2)_2CN$ | 1 |
| $NO_2$ | $NO_2$ | $SO_2CH_3$ | Cl | H | $(CH_2)_2COO(CH_2)_2OH$ | H | 4 |
| $NO_2$ | CN | $CF_3$ | H | $CH_3$ | $(CH_2)_2OH$ | $(CH_2)_2OH$ | 2 |
| $NO_2$ | CN | $CF_3$ | H | $NHCOCH_2OH$ | $CH_2CH{=}CH_2$ | $(CH_2)_2OCOCH_3$ | 1 |
| $NO_2$ | CN | $CF_3$ | H | $NHCOCH_2CN$ | $CH_2CH(OH)CH_2OH$ | H | 1 |
| $NO_2$ | CN | $CF_3$ | H | $NHCOC_2H_5$ | $CH_2CH(OH)CH_2O(CH_2)_2OCH_3$ | H | 1 |
| $NO_2$ | $SO_2CH_3$ | $CF_3$ | $O(CH_2)_2OH$ | H | $(CH_2)_2OH$ | $(CH_2)_2OH$ | 2 |
| $NO_2$ | $SO_2CH_3$ | $CF_3$ | Cl | H | $[(CH_2)_2O]_2CH_3$ | H | 4 |
| $NO_2$ | $SO_2CH_3$ | $CF_3$ | H | $NHCO(CH_2)_2Cl$ | $(CH_2)_2CN$ | $(CH_2)_2OCOCH_3$ | 1 |
| $NO_2$ | $NO_2$ | $CF_3$ | H | $NHCOCH_3$ | $C_2H_5$ | $C_2H_5$ | 1 |
| $SO_2CH_3$ | $SO_2CH_3$ | $CF_3$ | H | H | $C_6H_5$ | $(CH_2)_2OH$ | 3 |
| $PO(OCH_3)_2$ | $NO_2$ | $NO_2$ | H | H | $CH_2C_6H_5$ | $(CH_2)_2OH$ | 3 |
| $PO(OCH_3)_2$ | $NO_2$ | $NO_2$ | $O(CH_2)_2OCH_3$ | $NHCOCH_3$ | $[(CH_2)_2O]_2C_2H_5$ | $[(CH_2)_2O]_2C_2H_5$ | 1 |
| $PO(OCH_3)_2$ | $NO_2$ | $NO_2$ | H | $NHCH_2CN$ | $(CH_2)_2CN$ | $(CH_2)_2OH$ | 1 |
| $PO(OC_2H_5)_2$ | $NO_2$ | $NO_2$ | $CH_3$ | H | $CH_2CH(OH)CH_2OH$ | H | 3 |
| $PO(OCH_3)_2$ | $PO(OCH_3)_2$ | $NO_2$ | $O(CH_2)_2OCH_3$ | Cl | $[(CH_2)_2O]_2H$ | $[(CH_2)_2O]_2H$ | 2 |
| $PO(OCH_3)_2$ | CN | $NO_2$ | H | $NHCO(CH_2)_3OH$ | $(CH_2)_2CN$ | $(CH_2)_2OCOCH_3$ | 1 |
| $PO(OCH_3)_2$ | $SO_2CH_3$ | $NO_2$ | H | Cl | $(CH_2)_2OCOCH_2OC_6H_5$ | $C_2H_5$ | 2 |
| $PO(OCH_3)_2$ | $NO_2$ | CN | H | $NHCOCH_2Br$ | $(CH_2)_2COOCH_3$ | $CH_2CH{=}CH_2$ | 1 |
| $PO(OCH_3)_2$ | $SO_2CH_3$ | CN | H | $NHCOCH_2OH$ | $(CH_2)_2OCOC_2H_5$ | $(CH_2)_2OCOC_2H_5$ | 1 |
| $NO_2$ | CN | $COOCH_3$ | H | H | $(CH_2)_2OH$ | $(CH_2)_2CN$ | 4 |
| $NO_2$ | CN | $COOCH_3$ | Cl | H | $(CH_2)_2CN$ | H | 4 |
| $NO_2$ | $SO_2CH_3$ | $COOCH_3$ | H | $NHCOC_3H_7$ | $C_3H_7$ | $(CH_2)_2OH$ | 2 |
| $NO_2$ | $SO_2CH_3$ | $COOC_2H_5$ | H | $CH_3$ | $CH_2CH(OH)CH_2OH$ | $(CH_2)_2CN$ | 4 |
| $NO_2$ | $SO_2CH_3$ | $COO(CH_2)_2OH$ | Cl | H | $(CH_2)_2CN$ | H | 4 |
| $SO_2CH_3$ | $SO_2CH_3$ | $COO(CH_2)_2OH$ | H | H | $(CH_2)_2OCOCH_3$ | $CH_2CH{=}CH_2$ | 3 |
| $NO_2$ | $NO_2$ | $COO(CH_2)_2OCH_3$ | H | Cl | $CH_2CH_3$ | $(CH_2)_2OCOCH_3$ | 3 |
| $SO_2CH_3$ | CN | $COO(CH_2)_2OC_2H_5$ | $CH_3$ | H | $CH_2CH(OH)CH_2O(CH_2)_2OCH_3$ | H | 3 |
| $NO_2$ | CN | $SO_2NH_2$ | H | H | $(CH_2)_2CN$ | $(CH_2)_2OCOCH_3$ | 4 |
| $NO_2$ | CN | $SO_2NH_2$ | Cl | H | $(CH_2)_2CN$ | H | 4 |
| $NO_2$ | $SO_2CH_3$ | $SO_2NH_2$ | H | H | $[(CH_2)_2O]_2CH_3$ | $[(CH_2)_2O]_2CH_3$ | 4 |
| $NO_2$ | $SO_2CH_3$ | $SO_2NH_2$ | $CH_3$ | H | $CH_2CH(OH)CH_2OCH_3$ | H | 3 |
| $NO_2$ | $NO_2$ | $SO_2NH_2$ | H | $NHCOCH_3$ | $(CH_2)_2OCOCH_3$ | $(CH_2)_2OCOCH_3$ | 2 |
| $NO_2$ | CN | $SO_2NH(CH_2)_2OH$ | H | H | $(CH_2)_2CN$ | $(CH_2)_2CN$ | 4 |
| $SO_2CH_3$ | $SO_2CH_3$ | $SO_2NHC_4H_9$ | H | Br | $C_2H_5$ | $(CH_2)_2OH$ | 4 |
| $NO_2$ | $SO_2CH_3$ | $SO_2NH(CH_2)_2OH$ | H | H | $(CH_2)_2CN$ | $(CH_2)_2C_6H_5$ | 4 |
| $NO_2$ | CN | $SO_2N[(CH_2)_2OH]_2$ | H | H | $(CH_2)_2OH$ | $(CH_2)_2OC_6H_5$ | 3 |
| $NO_2$ | $SO_2C_2H_5$ | $SO_2N\{[(CH_2)_2O]_2CH_3\}_2$ | Cl | H | $(CH_2)_2CN$ | H | 4 |
| $COOCH_3$ | CN | $NO_2$ | H | H | $(CH_2)_2OCOCH_3$ | $CH_3$ | 3 |
| $COOCH_3$ | $NO_2$ | $NO_2$ | H | H | $(CH_2)_2CN$ | $(CH_2)_2OCOCH_3$ | 3 |
| $COOCH_3$ | $NO_2$ | $NO_2$ | Cl | H | $[(CH_2)_2O]_3H$ | H | 4 |
| $COOCH_3$ | $SO_2CH_3$ | $NO_2$ | H | $CH_3$ | $C_2H_5$ | $(CH_2)_2OH$ | 3 |
| $NO_2$ | CN | $COOC_2H_5$ | H | H | $(CH_2)_2OH$ | $(CH_2)_2CN$ | 4 |

TABLE-continued

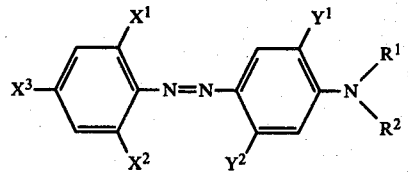

| $X^1$ | $X^2$ | $X^3$ | $Y^1$ | $Y^2$ | $R^1$ | $R^2$ | shade |
|---|---|---|---|---|---|---|---|
| $NO_2$ | CN | $COO(CH_2)_2OH$ | H | H | $(CH_2)_2OH$ | $(CH_2)_2CN$ | 4 |
| $NO_2$ | CN | $COOC_2H_5$ | H | H | $CH_2CH(OH)CH_2OH$ | $(CH_2)_2CN$ | 4 |
| $NO_2$ | CN | $COOC_2H_5$ | Cl | H | H | $(CH_2)_2OH$ | 4 |
| $NO_2$ | CN | $COOCH_3$ | Cl | H | H | $CH_2CH(OH)CH_2Cl$ | 4 |
| $NO_2$ | CN | $COOC_2H_5$ | H | Cl | $(CH_2)_2OH$ | $(CH_2)_2OH$ | 4 |
| $NO_2$ | CN | $COOC_2H_5$ | H | Cl | $(CH_2)_2OH$ | $(CH_2)_2CN$ | 4 |
| $NO_2$ | CN | $COOC_2H_5$ | H | $CH_3$ | $(CH_2)_2OH$ | $(CH_2)_2OH$ | 4 |
| $NO_2$ | CN | $COOCH_3$ | H | $CH_3$ | $(CH_2)_2OH$ | $(CH_2)_2CN$ | 4 |
| $NO_2$ | CN | $COOC_2H_5$ | H | $CH_3$ | $(CH_2)_2OH$ | $(CH_2)_2OCOCH_3$ | 4 |
| $NO_2$ | CN | $COOC_2H_5$ | H | $NHCOCH_3$ | $(CH_2)_2OH$ | $(CH_2)_2OH$ | 2 |
| $NO_2$ | CN | $COOCH_3$ | H | $NHCOCH_3$ | $(CH_2)_2OH$ | $(CH_2)_2CN$ | 2 |
| $NO_2$ | CN | $COO(CH_2)_2OCH_3$ | H | $NHCOC_2H_5$ | $(CH_2)_2OCOCH_3$ | $(CH_2)_2OCOCH_3$ | 2 |
| $NO_2$ | CN | $COOC_2H_5$ | $OCH_3$ | $NHCOCH_3$ | $(CH_2)_2OCOCH_3$ | $(CH_2)_2OCOCH_3$ | 1 |
| $NO_2$ | CN | $COOC_2H_5$ | $OCH_3$ | $NHCOCH_3$ | $(CH_2)_2OH$ | $(CH_2)_2OCOCH_3$ | 1 |
| $NO_2$ | CN | $COOC_2H_5$ | $OC_2H_5$ | $NHCOCH_3$ | $(CH_2)_2OH$ | $(CH_2)_2OH$ | 1 |
| $NO_2$ | CN | $COOC_2H_5$ | $OC_2H_5$ | $NHCOCH_3$ | $[(CH_2)_2O]_2H$ | $[(CH_2)_2O]_2H$ | 1 |
| $NO_2$ | CN | $COOCH_3$ | $OC_2H_5$ | $NHCOCH_3$ | $(CH_2)_2OH$ | $(CH_2)_2OCOCH_3$ | 1 |
| $NO_2$ | CN | $COOC_2H_5$ | $OCH_3$ | $NHCOCH_3$ | $(CH_2)_2CN$ | $(CH_2)_2OH$ | 1 |
| CN | CN | $COOC_2H_5$ | $OC_2H_5$ | $NHCOCH_3$ | $(CH_2)_2OCOCH_3$ | $(CH_2)_2OCOCH_3$ | 1 |
| $NO_2$ | CN | $COOCH_3$ | $OCH_3$ | $NHCOC_2H_5$ | H | $(CH_2)_2O(CH_2)_2CN$ | 1 |
| CN | CN | $COOC_2H_5$ | $OC_2H_5$ | $NHCOCH_3$ | H | $CH_2CH(OH)CH_2OCH_3$ | 1 |
| $NO_2$ | CN | $COOC_2H_5$ | $O(CH_2)_2OCH_3$ | $NHCOCH_3$ | H | $(CH_2)_2OH$ | 1 |
| CN | CN | $COOCH_3$ | $O(CH_2)_2OCH_3$ | $NHCOC_2H_5$ | H | $(CH_2)_2OH$ | 1 |
| $NO_2$ | CN | $COOCH_3$ | $O(CH_2)_2OCH_3$ | $NHCOCH_3$ | H | $CH_2CH(OH)CH_2Cl$ | 1 |
| CN | CN | $COOC_2H_5$ | $O(CH_2)_2OCH_3$ | $NHCOCH_3$ | H | $(CH_2)_2OCH_3$ | 1 |
| CN | CN | $COOC_2H_5$ | $OC_2H_5$ | $NHCOCH_3$ | $(CH_2)_2OH$ | $(CH_2)_2OH$ | 1 |
| CN | CN | $COOC_2H_5$ | $OC_2H_5$ | $NHCOCH_3$ | $(CH_2)_2OCOCH_3$ | $(CH_2)_2OH$ | 1 |
| CN | CN | $COOCH_3$ | $OC_2H_5$ | $NHCOCH_3$ | $[(CH_2)_2O]_3H$ | $[(CH_2)_2O]_3H$ | 1 |
| CN | CN | $COOC_2H_5$ | $OCH_3$ | $NHCOCH_3$ | $(CH_2)_2OH$ | $(CH_2)_2OH$ | 1 |
| CN | CN | $COOCH_3$ | $CH_3$ | $NHCOCH_3$ | $CH_2CH(OH)CH_2Cl$ | $CH_2CH(OH)CH_2Cl$ | 1 |
| CN | CN | $COOC_2H_5$ | $CH_3$ | $NHCOCH_3$ | $(CH_2)_2OH$ | $(CH_2)_2OH$ | 1 |
| CN | CN | $COOC_2H_5$ | Cl | $NHCOCH_3$ | $[(CH_2)_2O]_2H$ | $[(CH_2)_2O]_2H$ | 1 |
| CN | CN | $COOC_2H_5$ | H | $NHCOCH_3$ | $(CH_2)_2OH$ | $(CH_2)_2CN$ | 2 |
| CN | CN | $COOC_2H_5$ | H | $NHCOCH_3$ | $(CH_2)_2OH$ | $(CH_2)_2OH$ | 2 |
| CN | CN | $COOCH_3$ | H | H | $(CH_2)_2CN$ | $(CH_2)_2OH$ | 4 |
| CN | CN | $COOC_2H_5$ | H | H | $(CH_2)_2OH$ | $(CH_2)_2OH$ | 4 |
| CN | CN | $COOC_2H_5$ | H | H | $(CH_2)_2CN$ | $CH_2CH(OH)CH_2OH$ | 4 |
| CN | CN | $COOC_2H_5$ | Cl | H | H | $[(CH_2)_2O]_2CH_3$ | 4 |
| CN | CN | $COOC_2H_5$ | Cl | H | H | $CH_2CH(OH)CH_2OCH_3$ | 4 |
| CN | CN | $COOCH_3$ | H | $CH_3$ | $(CH_2)_2OH$ | $(CH_2)_2CN$ | 3 |
| $NO_2$ | $NO_2$ | $COOC_2H_5$ | H | H | $(CH_2)_2OH$ | $(CH_2)_2CN$ | 4 |
| $NO_2$ | $NO_2$ | $COOCH_3$ | H | H | $(CH_2)_2OCOCH_3$ | $(CH_2)_2CN$ | 4 |
| $NO_2$ | $NO_2$ | $COOC_2H_5$ | $OCH_3$ | $NHCOCH_3$ | $(CH_2)_2OH$ | $(CH_2)_2OH$ | 1 |

TABLE-continued

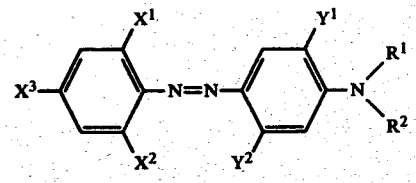

| $X^1$ | $X^2$ | $X^3$ | $Y^1$ | $Y^2$ | $R^1$ | $R^2$ | shade |
|---|---|---|---|---|---|---|---|
| $NO_2$ | $NO_2$ | $COOC_2H_5$ | $OCH_3$ | $NHCOCH_3$ | $(CH_2)_2OCOCH_3$ | $(CH_2)_2OCOCH_3$ | 1 |
| $NO_2$ | $NO_2$ | $COOCH_3$ | $OC_2H_5$ | $NHCOCH_3$ | $(CH_2)_2OH$ | $(CH_2)_2OH$ | 1 |
| $NO_2$ | $NO_2$ | $COOC_2H_5$ | $OC_2H_5$ | $NHCOCH_3$ | $(CH_2)_2OCOCH_3$ | $(CH_2)_2OH$ | 1 |
| $NO_2$ | $NO_2$ | $COOCH_3$ | H | $NHCOC_2H_5$ | $(CH_2)_2CN$ | $CH_2CH(OH)CH_2Cl$ | 2 |
| $COOCH_3$ | $NO_2$ | $NO_2$ | H | H | $(CH_2)_2CN$ | $(CH_2)_2OH$ | 4 |
| $COOCH_3$ | $NO_2$ | $NO_2$ | H | $CH_3$ | $(CH_2)_2CN$ | $(CH_2)_2OCOCH_3$ | 3 |
| $COOCH_3$ | $NO_2$ | $NO_2$ | H | H | $C_2H_5$ | $(CH_2)_2OH$ | 4 |
| $COOC_2H_5$ | $NO_2$ | $NO_2$ | H | H | $C_2H_5$ | $CH_2CH(OH)CH_2Cl$ | 4 |
| $COOCH_3$ | $NO_2$ | $NO_2$ | Cl | H | $CH_2CH(OH)CH_2OH$ | H | 4 |
| $COOCH_3$ | CN | $NO_2$ | H | H | $(CH_2)_2CN$ | $[(CH_2)_2O]_2CH_3$ | 4 |
| $COOCH_3$ | CN | $NO_2$ | H | H | $[(CH_2)_2O]_3CH_3$ | $[(CH_2)_2O]_3CH_3$ | 4 |
| $COOCH_3$ | CN | $NO_2$ | $OCH_3$ | $NHCOCH_3$ | $(CH_2)_2OH$ | $(CH_2)_2OH$ | 1 |
| $COOCH_3$ | $NO_2$ | $NO_2$ | $OC_2H_5$ | $NHCOCH_3$ | $(CH_2)_2OCOCH_3$ | $(CH_2)_2OCOCH_3$ | 1 |
| $COOCH_3$ | CN | $NO_2$ | $OC_2H_5$ | $NHCOCH_3$ | $(CH_2)_2OH$ | $(CH_2)_2OCOCH_3$ | 1 |
| $COOC_2H_5$ | $NO_2$ | $NO_2$ | $OC_2H_5$ | $NHCOCH_3$ | $[(CH_2)_2O]_2CH_3$ | $[(CH_2)_2O]_2CH_3$ | 1 |

In the above table, the figures shown in the "Shade" column have the following meaning:
1 = blue
2 = violet
3 = ruby
4 = red The denotation —OCO— in one of the radicals means $-O-\overset{O}{\overset{\|}{C}}-$.

What is claimed is:

1. In the process for production of discharge reserve prints on textile materials comprising water-repellent fibers or mixed water-repellent and cellulose fibers wherein a disperse dyestuff which is dischargeable to white is applied to the textile material in the form of a dye liquor or dye printing paste, at least partially drying the textile material, applying a discharge reserve printing paste to the material by printing on the material in the desired pattern and subsequently heating the printed material at temperatures from 100° to 230° C., the improvement comprises (a) the discharge reserve printing paste containing, as the discharging agent, an alkaline material which produces a pH value of at least 8 in 5% strength aqueous solution and (b) the disperse dyestuff which is dischargeable to white is a disperse dyestuff of the formula

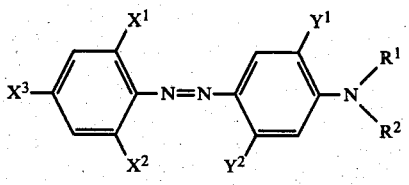

wherein $X^1$, $X^2$ and $X^3$ independently of one another are nitro, cyano, alkylsulphonyl having 1 to 4 carbon atoms, phenylsulphonyl chlorophenylsulphonyl, bromophenylsulphonyl, tolylsulphonyl, cyanophenylsulphonyl, dialkylphosphono having 1 to 4 carbon atoms in each alkyl moiety, aminosulphonyl, alkylaminosulphonyl having 1 to 4 carbon atoms in the alkyl moiety, dialkylaminosulphonyl having 1 to 4 carbon atoms in each alkyl moiety, or trifluoromethyl, said alkylaminosulphonyl and dialkylaminosulphonyl being unsubstituted or alkyl substituted by hydroxy, methoxy, ethoxy or methoxyethoxy;

with the proviso that not more than 2 of $X^1$, $X^2$ and $X^3$ are said aminosulphonyl, said unsubstituted or substituted alkylaminosulphonyl, said unsubstituted or substituted dialkylaminosulphonyl, said trifluoromethyl, said dialkylphosphono, said alkylsulphonyl, said phenylsulphonyl, said chlorophenylsulphonyl, said bromophenylsulphonyl, said tolylsulphonyl, or said cyanophenylsulphonyl, $Y_1$ and $Y^2$ independently of one another are each hydrogen, chloro, bromo, alkyl of 1 to 4 carbon atoms, substituted alkyl of 1 to 4 carbon atoms substituted by 1 or 2 hydroxyls, alkoxy having 1 to 4 carbon atoms, or substituted alkoxy having 1 to 4 carbon atoms substituted by hydroxyl or disubstituted by hydroxyl or alkoxy having 3 to 8 carbon atoms and being optionally monosubstituted or polysubstituted by hydroxyl and wherein the carbon chain is interrupted by 1 to 3 oxygen atoms;

$Y^2$ is additionally —NHCOZ wherein Z is methyl, ethyl, propyl or i-propyl unsubstituted or substituted by hydroxyl, chloro, bromo, cyano, phenyl, phenoxy or Z is alkyl of 3 to 8 carbon atoms interrupted between one and three times by oxygen which is unsubstituted or substituted by hydroxyl, phenyl, amino or N-alkylamino having 1 to 4 carbon atoms;

$R^1$ is hydrogen or alkyl having 1 to 4 carbon atoms substituted by at least one substituent selected from chloro, bromo, cyano, hydroxyl, methoxy, ethoxy, phenyl, phenoxy, and alkylaminocarbonyloxy having 1 to 4 carbon atoms in the alkyl moiety; or $R^1$ is additionally alkenyl having 3 to 4 carbon atoms, benzyl, cycloalkyl having 5 to 6 carbon atoms, or alkyl having 3 to 8 carbon atoms wherein the carbon chain is interrupted by 1 to 3 oxygen atoms and is unsubstituted or substituted by hydroxyl, chloro, bromo or cyano;

$R^2$ is alkyl having 3 to 8 carbon atoms wherein the carbon chain is interrupted by 1 to 3 oxygen atoms and is unsubstituted or substituted by hydroxyl, chloro, bromo or cyano.

2. The process according to claim 1 wherein the alkaline material of (a) is an alkali metal carbonate or bicarbonate.

3. The process according to claim 1 or claim 2 wherein the textile material is a polyester/cellulose mixed fabric and wherein said dye liquor or said dye printing paste also contains at least one dischargeable reactive dyestuff having a reactive moiety selected from the formulae consisting of $$-SO_2-CH_2-CH_2-Hal,$$

$$-SO_2-CH_2-CH_2-OSO_3X,$$

$$-NH-SO_2-CH_2-CH_2-OSO_3X, \text{ and}$$

$$-SO_2-CH=CH_2$$

wherein X is hydrogen or a metal cation and Hal is halogen; and said discharge reserve printing paste also contains an alkali metal sulphite or bisulphite.

4. The process according to claim 3 wherein said dye liquor or said dye printing paste also contains a reactive dyestuff resistant to discharging.

5. The process according to claim 3 wherein the printed material is heated to temperatures from 100° to 110° C.

6. The process according to claim 1 wherein the textile material is impregnated with a padding liquor.

7. The process according to claim 1 wherein $X^1$ is methylsulphonyl, ethylsulphonyl, trifluoromethyl, cyano, or nitro.

8. The process according to claim 1 wherein $X^2$ is methylsulphonyl, ethylsulphonyl, nitro or cyano.

9. The process according to claim 1 wherein $X^3$ is selected from nitro, aminosulphonyl, alkylaminosulphonyl having 1 to 4 carbon atoms in the alkyl moiety which is unsubstituted or substituted, alkylsulphonyl having 1 to 4 carbon atoms, phenylsulphonyl, chlorophenylsulphonyl, bromophenylsulphonyl, tolylsulphonyl and cyanophenylsulphonyl, wherein the substituted moiety substituents are selected from hydroxyl, methoxy, ethoxy and methoxyethoxy.

10. The process according to claim 1 wherein $X^1$ and $X^2$ independently of one another are each nitro or cyano.

11. The process according to claim 1 wherein $X^1$ and $X^2$ independently of one another are each nitro or cyano and $X^3$ is aminosulphonyl or alkylaminosulphonyl having 1 to 4 carbon atoms in the alkyl moiety which is unsubstituted or substituted by hydroxyl, methoxy, ethoxy or methoxyethoxy.

* * * * *